United States Patent [19]

Vertegaal

[11] Patent Number: 4,509,454

[45] Date of Patent: Apr. 9, 1985

[54] PRINTING APPARATUS, PARTICULARLY ADAPTED TO APPLY A VARNISH

[75] Inventor: Jacobus G. Vertegaal, Boxmeer, Netherlands

[73] Assignee: Stork Brabant B.V., Netherlands

[21] Appl. No.: 498,843

[22] Filed: May 27, 1983

[30] Foreign Application Priority Data

Jun. 2, 1982 [DE] Fed. Rep. of Germany ... 8215996[U]

[51] Int. Cl.[3] ..... B05C 1/02

[52] U.S. Cl. ..... 118/681; 118/211; 118/231; 118/241; 118/262; 118/249; 101/119

[58] Field of Search ..... 118/241, 231, 262, 211, 118/213, 680, 681, 249; 101/120, 119

[56] References Cited

U.S. PATENT DOCUMENTS 2,300,078 10/1942 Vonhofe ..... 118/241 X
3,431,844 3/1969 Ogden ..... 101/234
3,685,442 8/1972 Harwell, Jr. ..... 101/119
4,070,964 1/1978 Vertegaal ..... 101/120

*Primary Examiner*—John P. McIntosh
*Attorney, Agent, or Firm*—Ostrolenk, Faber, Gerb & Soffen

[57] ABSTRACT

The invention relates to an apparatus adapted to apply a layer of viscous sticky material, particularly varnish, in the form of a pattern or otherwise, to a substrate. The apparatus comprises an applicator roll 1, and an impression roll 2, between which sheets 3 for printing are fed, by feed means.

The means for applying the varnish to the applicator roll consist of a cylindrical screen stencil 8 with an internal squeegee device 9.

The applicator roll is also displaceable so that it can be moved away from the impression roll 2 in the absence of a sheet to be printed in the event of a malfunction in the feed means.

8 Claims, 1 Drawing Figure

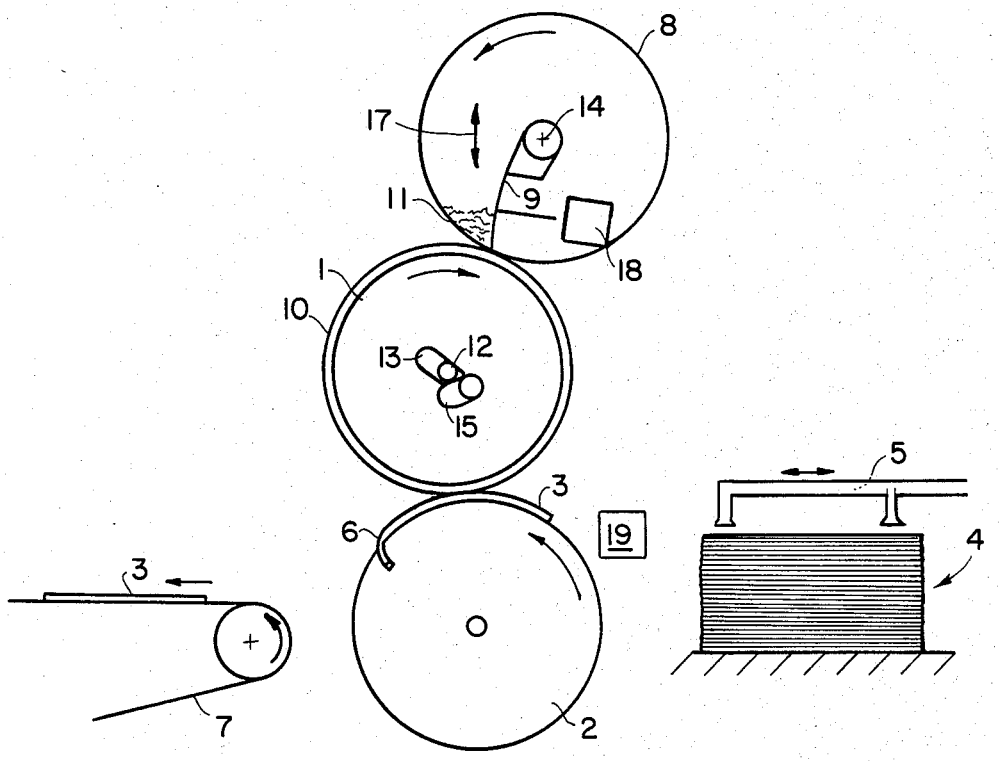
8
17
14
11
9
18
1
10
13
12
15
3
6
19
5
4
3
7
2

PRINTING APPARATUS, PARTICULARLY ADAPTED TO APPLY A VARNISH

BACKGROUND OF THE INVENTION

1. Field of the Invention

The present invention relates to a printing apparatus particularly but not exclusively adapted to apply a layer of viscous sticky material, particularly varnish, in the form of a pattern or otherwise, to a substrate comprising an applicator roll and means for applying the viscous material to said roll, the substrate being fed by feed means between the applicator roll and an impression roll in order to take up the viscous material.

2. Description of the Prior Art

In the prior art apparatus for applying a varnish in a pattern or otherwise to a substrate has been used, in the form of a gravure roll to which the varnish is fed and then skimmed off by a squeegee device. The varnish is then transferred from the gravure roll to the applicator roll and from there to the substrate material. This action has proved to be detrimental, as varnish consists of a viscous and sticky substance, and tends to stick in the grooves of the gravure roll. This occurs particularly when a relatively thick layer has to be applied to the substrate material and the grooves of the gravure roll are correspondingly deep.

Even if varnish is to be applied without a pattern and accordingly a smooth applicator roll is used, the drawback arises that it is difficult to apply a uniformly thick layer of varnish to said applicator roll so that there again only one thin layer of varnish can be applied on each treatment.

SUMMARY OF THE INVENTION

It is a principal object of the present invention to provide a printing apparatus suitable particularly for applying a varnish with which the above drawbacks are obviated.

To this end, according to the invention, the means for applying the viscous material to the applicator roll consist of a cylindrical screen stencil with an internal squeegee device.

With a screen stencil of this kind, a layer of varnish of the required thickness can be applied to the applicator roll in a simple manner, without the above difficulties occurring.

It should be noted that the use of a cylindrical screen stencil with an internal squeegee device is known per se from offset printing, but the latter screen stencils are used solely for printing with aqueous or solvent-containing liquids such as ink and paint.

When varnish is applied to separate sheets of cardboard, paper, metal or other material cut to size, the sheets being fed in known manner from a pile to the impression roll by suction cups, which guide them along the applicator roll, the disadvantage arises that the sticky varnish may reach the impression roll in the absence of a sheet, due to malfunction in the feed means or the like. In that case the impression roll will be badly soiled so that when the malfunction is cleared said impression roll has first to be cleaned.

According to the present invention this drawback is obviated by the fact that the applicator roll is displaceable over an arcuate path whose center coincides with the center-line of the cylindrical screen stencil, means being provided to remove the applicator roll from the impression roll in the absence of a sheet to be printed between the two rolls.

Thus the applicator roll can be moved away from the impression roll while contact between the applicator roll and the cylindrical screen stencil is maintained. Preferably, the squeegee device is simultaneously lifted from the stencil so that it is no longer in contact with the stencil and no varnish is transferred to the applicator roll.

A considerable frictional force in a direction opposite to the direction of rotation of the screen stencil, is applied to the inside of the cylindrical screen stencil by the viscous sticky material and the squeegee device. This frictional force will cause a deformation of the relatively limp screen stencil.

Since, according to the invention, the circumferential speed of the applicator roll is 2–4% greater than that of the cylindrical screen stencil, the applicator roll exerts an opposite force on the stencil, and this force counteracts the deformation of said stencil due to the frictional force of the squeegee device.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE DRAWINGS

The accompanying drawing, schematically illustrates the apparatus according to the invention.

DESCRIPTION OF THE PREFERRED EMBODIMENTS

The device according to the invention consists of an applicator roll 1 and an impression roll 2, between which rolls sheets 3 of paper, metal or other material are fed. The sheets 3 are fed from a pile 4 to the impression roll 2 by a feed means 5 which, for example, comprises suction cups. The impression roll is provided with means 6 to engage the separate sheets and then release them after printing, whereupon the printed sheet is transferred to the conveyor 7. Applicator roll 1 cooperates with a cylindrical screen stencil 8, inside which is disposed a squeegee device 9. Applicator roll 1 is also provided with a hard smooth rubber covering 10.

Applicator roll 1, impression roll 2 and cylindrical screen stencil 8 are all driven in the direction of the arrows illustrated. The varnish 11 to be applied, consisting of a sticky and viscous substance, is fed to the cylindrical screen stencil by means known per se and applied to the applicator roll 1 by means of the squeegee device 9. From the applicator roll 1 the varnish is then transferred to the sheets 3 advancing between said roll and the impression roll 2. Obviously the separate sheets 3 illustrated in the drawing and consisting for example of cardboard or the like cut to size, may also consist of a continuous web.

The applicator roll 1 is guided by its trunnions 12 in arcuate slots 13 whose center of curvature coincides with the center-line 14 of the cylindrical screen stencil 8. In this way the applicator roll can be disengaged from the impression roll in the absence of a sheet 3 between said rolls, due to a malfunction. As a result of the arcuate slots, however, the applicator roll remains in contact with the screen stencil.

The latter is important for a continued support of the squeegee and to obviate damage to the stencil. Simultaneously with the disengagement of the applicator roll the squeegee is lifted as shown by double headed arrow 17 from the stencil by lift means 18 so that no more varnish is applied to the applicator roll. Lifting of the squeegee takes a longer period of time because of the longer distance to be traversed. Correct co-ordination of these movements provides the possibility of quick reaction in the absence of a sheet to be varnished, printed resp., thus obviating soiling of the impression roll and additional, time-consuming, cleaning.

Disengagement of the applicator roll can be effected, for example, by means of a cam disk 15, the drive of which is controlled, for example, by a photosensitive cell 19 at the impression roll 2, which detects whether a sheet to be printed is present.

Since, as already stated, the varnish 11 consists of sticky viscous substance, this material together with the squeegee device 9, will exert a considerable frictional force on the cylindrical screen stencil 8 in opposition to the direction of movement of this cylinder. Since the stencil 8 is fairly limp, it might be deformed slightly as a result. This deformation is, however, counteracted by exerting an opposite force on the outside of the cylindrical screen stencil, produced as a result of the fact that the circumferential speed of the applicator roll is slightly higher than that of the cylindrical screen stencil. Thus a slight slip occurs between the two rolls, resulting in an oppositely directed frictional force. The higher circumferential speed of the applicator roll is achieved by the fact that the applicator roll 1 which is driven at the same speed as the screen stencil has a slightly larger diameter than the cylindrical screen stencil 5, the difference being in the order of 2–4%.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. Apparatus adapted to apply a layer of viscous sticky material, particularly varnish, in the form of a pattern or otherwise, to a substrate, comprising an applicator roll and means for applying the viscous material to said roll, the substrate being fed by feed means between the applicator roll and an impression roll, the means for applying the viscous material to the applicator roll consisting of a cylindrical screen stencil with an internal squeegee, means for rotating said applicator roll and said cylindrical screen stencil in opposite directions to produce a circumferential movement of the applicator roll and screen stencil in the same direction at the point where they meet, the circumferential speed of the applicator roll being greater than that of the cylindrical screen stencil.

2. Apparatus according to claim 1, in which the substrate consists of separate sheets cut to size, the applicator roll being displaceable over an arcuate path whose center coincides with the center-line of the cylindrical screen stencil, means being provided to move the applicator roll away from the impression roll in the absence of a sheet to be printed between the two rolls.

3. Apparatus according to claim 2, wherein means are provided to lift the squeegee device off the screen stencil substantially simultaneously with the movement of the applicator roll.

4. Apparatus according to claim 2, wherein the means for moving the applicator roll away from the impression roll, consist of a rotating cam disk controlled by a photosensitive cell, which detects whether or not a sheet is present on the impression roll.

5. Apparatus according to claim 1, wherein the said circumferential speed of the applicator roll is 2–4% greater than that of the cylindrical screen stencil.

6. The apparatus of claim 1, wherein the applicator roll is larger in diameter than the said cylindrical screen stencil.

7. The apparatus of claim 6, wherein the applicator roll and the cylindrical screen stencil are driven at the same number of revolutions per minute, the circumferential speed of the applicator roll being greater than that of the screen stencil.

8. The apparatus of claim 7, wherein the slippage occurs between the surfaces of the applicator roll and the screen stencil causing a frictional force in the direction of circumferential movement.

* * * * *